US005778482A

United States Patent [19]

Sbrigato

[11] Patent Number: 5,778,482

[45] Date of Patent: Jul. 14, 1998

[54] SPREADER FOR COLD-COAT ROOFING TAR

[76] Inventor: Charles Sbrigato, 45 Lancaster Ave., Brooklyn, N.Y. 11223

[21] Appl. No.: 690,725

[22] Filed: Jul. 31, 1996

Related U.S. Application Data

[63] Continuation of Ser. No. 286,519, Aug. 5, 1994, abandoned.

[51] Int. Cl.[6] ..... B05C 17/10; B05C 17/00

[52] U.S. Cl. ..... 15/245.1; 15/235.4; 15/236.08; 404/97; 404/118

[58] Field of Search ..... 15/245.1, 235.3, 15/235.4, 235.5, 235.6, 235.7, 235.8, 236.08; 404/118, 98, 97

[56] References Cited

U.S. PATENT DOCUMENTS

| | | | |
|---|---|---|---|
| 774,005 | 11/1904 | Thies | 15/235.6 |
| 1,144,891 | 6/1915 | Cannon | 15/245.1 |
| 2,081,735 | 5/1937 | Caronia | 15/245.1 |
| 2,287,231 | 6/1942 | Cathcard et al. | 15/245.1 |
| 2,410,343 | 10/1946 | Haivala | 72/136 |
| 2,578,163 | 12/1951 | Whalen | 15/235.4 |
| 2,824,330 | 2/1958 | Williams | 15/236 |
| 2,913,753 | 11/1959 | Peterson | 15/245.1 |
| 3,053,311 | 9/1962 | Nottage | 15/235.5 |
| 3,091,790 | 6/1963 | Schroeder | 15/105 |
| 3,119,138 | 1/1964 | Davis | 15/236 |
| 3,274,684 | 9/1966 | Marks | 15/236.08 |
| 3,611,470 | 10/1971 | Gaston | 15/235.6 |
| 4,254,980 | 3/1981 | Anderson | 15/235.6 |
| 4,982,470 | 1/1991 | Szabo | 15/235.6 |

*Primary Examiner*—Gary K. Graham
*Attorney, Agent, or Firm*—Kalow, Springut & Bressler

[57] ABSTRACT

A device for spreading cold-coat tar for securing roofing paper, comprising a hard rubber blade with serration, which, when pushed over the surface to be roofed, spreads the desired coat of tar over a predetermined width of the surface to be roofed.

17 Claims, 3 Drawing Sheets

SPREADER FOR COLD-COAT ROOFING TAR

This application is a continuation of application Ser. No. 08/286,519, filed 5 Aug. 1994, now abandoned.

BACKGROUND OF THE INVENTION

This invention relates to a novel spreader for viscous materials, more particularly to the spreading of cold-coat tar and similar substances used in the roofing industry.

This invention relates to the well-known method of placing roofs on flat buildings which consists of applying a uniform layer of cold-coat tar on the surface and affixing a strip of roofing paper with the tar. The goal of the invention is to address the desire of roofers to provide a coating of tar sufficient to adhere the roofing paper to the surface, but as close as possible to the minimum thickness required in order to avoid waste. The application of such coatings by known methods is relatively difficult and laborious.

Presently, there are a number of methods for applying cold-coat tar used in the roofing industry. The most common is by a hand trowel, which entails the roofer, on his hands and knees, spreading the desired coating of tar. This method is time consuming and results in pain and injuries to the roofer's back, hands and knees. Because of the laborious nature of this method, the work is slow and tedious.

Another method of application of cold-coat tar is by a squeegee, a flexible rubber blade in a holder, which enables the tar to be spread more rapidly, but with the counterbalancing problems of obtaining the coating of desired thickness. When the tar is applied by a squeegee, the work progresses more rapidly and with far greater ease than with a trowel, but it requires a relatively high degree of skill and difficult manipulation of the squeegee to obtain a coating of the desired thickness, because the squeegee tends to produce only a relatively thin coating and to wipe off all but a relatively thin layer of the tar.

A type of squeegee used for the spreading of cold-coat roofing is disclosed and claimed in Davis U.S. Pat. No. 3,119,138, issued Jan. 28, 1964. That patent discloses a squeegee with a flexible, resilient, working blade in a wooden holder connected to a handle. The working blade has grooves of uniform depth extending along a least one of its side surfaces. When the blade is flexed and the side surface contacts the roof, the grooves act to mete out the roofing tar in narrow, adjacent and parallel ribbons. The squeegee of this disclosure also has serrations on its bottom edge which engage the surface to be coated and ensure that the desired flexing of the blade is achieved.

The solution of U.S. Pat. No. 3,119,138 to the problem of spreading cold-coat tar entails the use of a flexible working blade and therefore retains some of the problems inherent in the use of a squeegee. A flexible squeegee blade suffers intense wear and tear from constant bending and recovery. This wear and tear forces frequent and expensive replacement of the blade. A flexible blade is also subject to changes in temperature, resulting in inconsistencies in the coating applied. Users of squeegee-type spreaders of cold-coat tar also are slowed in the spreading of the tar by any overflow that occurs. FIG. 5 of U.S. Pat. No. 3,119,138 illustrates the side guards added in an attempt to overcome this problem. However, a certain amount of tar will run out the sides when the blade is flexed, despite the guards. Additional overflow of tar is possible over the top of the squeegee-holding block. The overflow causes the roofer to have to back up and spread the overflow tar, resulting in both wasted time and materials.

Another method for roofing buildings currently used is the so-called "Torch Down" method. This method, in contrast to cold-coat roofing, utilizes squares of roofing paper impregnated with tar. The tar-impregnated paper is set down on the surface to be roofed and a propane torch, or other source of intense heat, is used to melt the tar. The melted tar adheres to the roof and forms a bond between the roof and the paper.

There are many problems inherent in the Torch Down method, one of which is the danger of fires. The equipment and materials are very expensive and insurance is hard to obtain.

SUMMARY OF THE INVENTION

It is the general object of the present invention to provide a novel spreading device for spreading relatively viscous materials, such as cold-coat tar, on surfaces to be roofed.

More specifically, the object of the invention is to provide a spreader with a stiff working blade of predetermined width with a number of serrations of predetermined depth and spacing, in a holder with a handle. The novel spreader of the invention is used to push and spread cold-coat tar over a surface area to be roofed and will produce a coating of desired thickness.

Another object of the invention is to provide a novel spreader wherein the stiff working blade is contained in a holder which has a hood designed to prevent overflow of the cold-coat tar, thus keeping the workplace and spreader as clean and neat as possible and further minimizing waste.

Another related object of this invention is to provide a method wherein the novel spreader of predetermined width is used to spread cold-coat tar over a predetermined width of surface to be roofed and automatically overlap a portion of the previously laid sheet of roofing paper. This method ensures that each successive sheet of paper is securely attached to the roof and overlaps the preceding sheet of paper, thereby efficiently sealing the roofed surface from the elements. Further, by a slight adjustment in the angle of the blade, the roofer can automatically leave a small bead of tar which is used to seal the edge of the paper.

DESCRIPTION OF THE PREFERRED EMBODIMENTS

While the invention will be described in connection with a preferred embodiment, it will be understood that it is not intended to limit the invention to the described embodiment. On the contrary, it is intended to cover all the alternatives, modifications and equivalents as may be included within the spirit and scope of the invention as defined by the appended claims.

The spreader of the present invention overcomes the problems inherent in the prior art methods and devices for spreading cold-coat tar. When preparing a built-up roof, it is often desired to spread individual, relatively narrow strips of cold-coat tar. After the tar is spread, a sheet of roofing paper is laid on top of the tar, forming a bond between the paper and the roof surface. The step of laying of the roofing paper is called "walking out" the paper, since the roofer will literally walk out a roll of paper, unrolling the paper over the previously spread tar. Each sheet of roofing paper is overlapped in part by successively laid sheets of roofing paper.

The inventive spreader includes a stiff, non-resilient working blade of predetermined length. The blade is affixed to a handle in such a way that the blade acts to spread a layer of cold-coat tar along the surface to be roofed when the blade/handle combination is pushed by the roofer. The working blade has serrations of uniform depth extending along the bottom surface of the working blade. The serrations are evenly spaced and function to mete out the cold-coat tar in narrow, adjacent and parallel ribbons.

The adjacent parallel ribbons of cold-coat tar, after being meted out by the serrations of the working blade of the inventive spreader, flow together and form a consistent, uniform layer of cold-coat tar, unto which the roofing paper is placed.

Figures 1, 2:
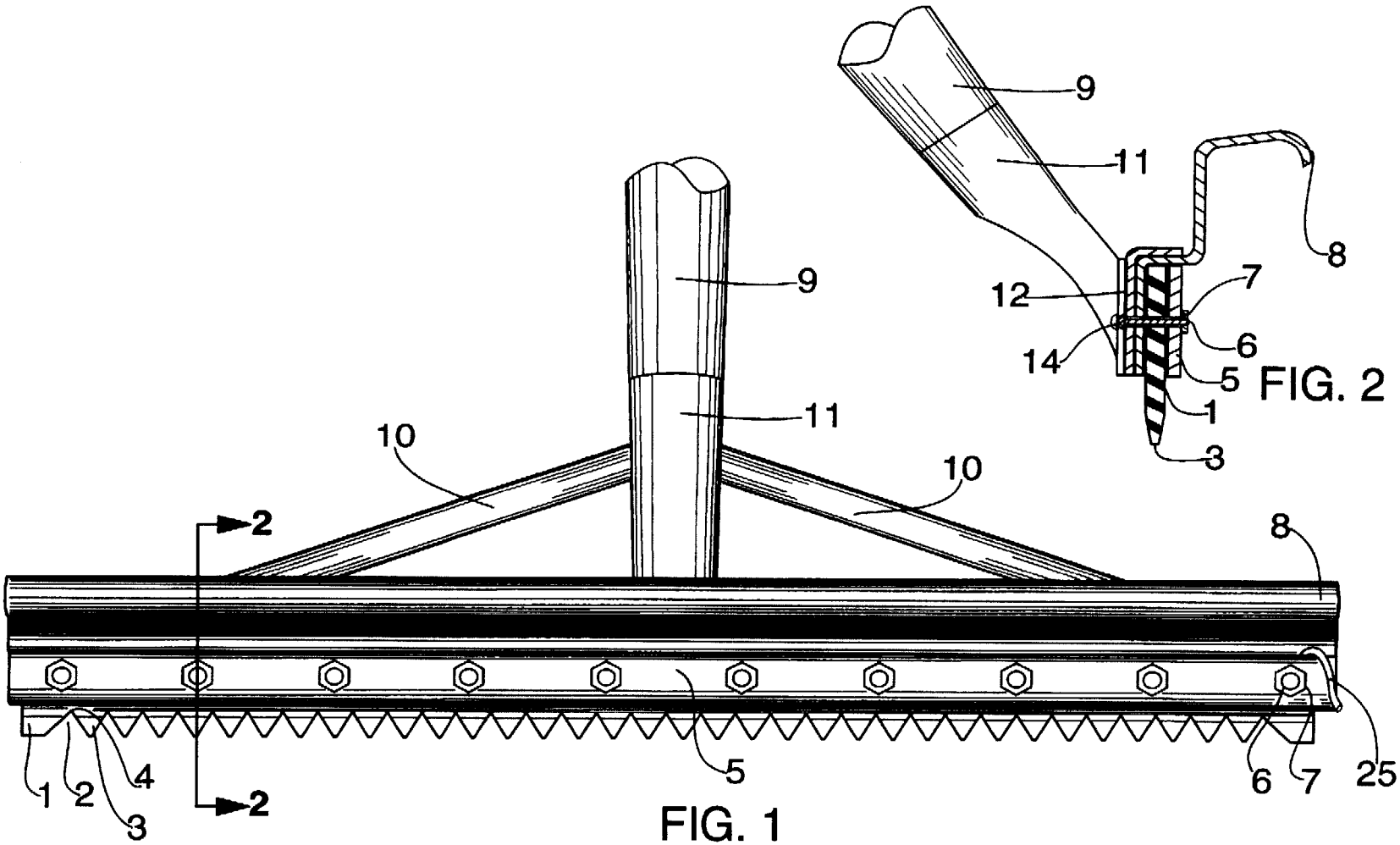
FIG. 1 is a front-elevation view of the spreader according to the present invention.
FIG. 2 is a cross-sectional view of the spreader taken along line 2—2 of FIG. 1.

FIG. 1 illustrates a preferred embodiment of the inventive device. The working blade 1 is preferably a non-resilient, stiff material, more preferably, hard rubber. The blade 1 is of some pre-determined length and is preferably approximately one-quarter inch (¼") thick and approximately two and one-quarter inches (2¼") in height. It is important that the blade 1 does not flex when the spreader is pushed and further that the blade 1 is resistant to wear. However, some wear is inevitable and therefore the blade 1 is easily replaced.

The blade 1 has serrations 2 spaced throughout the bottom of the blade 1. Those serrations form teeth 3 which act to engage the surface of the roof. The top of the serrations 4 are spaced evenly a predetermined distance from each other. Preferably, the top of the serrations 4 are one inch apart. The serrations 2 are made a predetermined height, preferably one-half inch (½") high. The serrations 2 and teeth 3 continue for the entire length of the blade 1.

Typically, the roofing paper is made of felt paper, sometimes impregnated with mica. The paper comes in rolls containing 100 square feet of material, weighing approximately 90 pounds when impregnated with mica, 65 pounds if not. In the most common usage, the roofing paper is typically thirty-six inches (36") wide with a built-in overlap. The paper is laid in adjacent rows, covering the roof in a way that each row of paper overlaps a certain portion of the preceding paper. Typically, the roofing paper includes a built-in four inch (4") overlap. The overlap protects the roof from the elements by preventing gaps between the successive sheets of paper. Another type of paper includes double layering for extra insulating properties. This paper is also 36" wide and includes a seventeen inch (17") overlap.

As stated previously, the working blade 1 is of some predetermined width. While the blade can be of any width and still practice the invention, the preferred length corresponds to the width of the strip of paper to be laid, in the typically case, thirty-six inches (36"). The use of a 36" wide blade ensures that the roofer can lay a coat of cold-coat tar exactly the width of the paper and covering the built-in overlap on the previously laid strip of paper. Thus, by pushing the tar with the inventive spreader, the roofer can, with one trip, spread the desired amount of tar needed to secure the strip of paper to be laid. This is a dramatic improvement over the previously used methods and devices in that it saves a large amount of time and effort.

The blade 1 is held in place by a bar 5 which corresponds in length to the width of the blade 1. The bar 5 is preferably made of a metal material.

The bar 5 and blade 1 are held in place by a number of nut 7 and bolt 6 connections which are illustrated more clearly in FIG. 2.

Above the bar 5 and blade 1 is a hood 8 used to control any overflow of cold-coat tar. The hood 8 is preferably made out of a bent sheet metal, curved so that the hood 8 extends out and over the bar 5 and the blade 1. Preferably, the hood 8 is attached to the blade 1 and bar 5 through the means of the nut 7 and bolt 6 connections. The hood 8 prevents the tar from overflowing the spreader and keeps the workplace as neat and clean as possible.

The hood 8 also minimizes waste by preventing excess tar from spilling over the top of the blade 1 and retaining the excess material in front of the blade 1. The excess tar is thereby spread out in front of the blade 1, ensuring that all the tar is used efficiently.

In a still more preferred embodiment the hood 8 is provided with a run-off tube 25 which acts to take a portion of the excess cold-coat tar and form a bead of tar on the previously laid sheet of paper. This bead is used to seal off the very edge of the subsequently laid sheet of roofing paper, thus preventing water from entering between the two sheets of paper.

A handle 9 is attached to the spreader by bracket 11. The handle 9 is preferably a heavy-duty wooden rod.

Braces 10 secure the handle 9, ensuring a strong and secure connection.

FIG. 2 is cross-sectional view of the spreader taken along line 2—2 of FIG. 1. FIG. 2 further illustrates one of the nut 7 and bolt 6 connection of the blade 1, the bar 5 and the hood 8. An L-bracket 12 is attached by means of the nut 7 and bolt 6 to the bar 5, hood 8 and blade 1. The head 14 of the bolt extends through the L-bracket 12.

Figure 3:
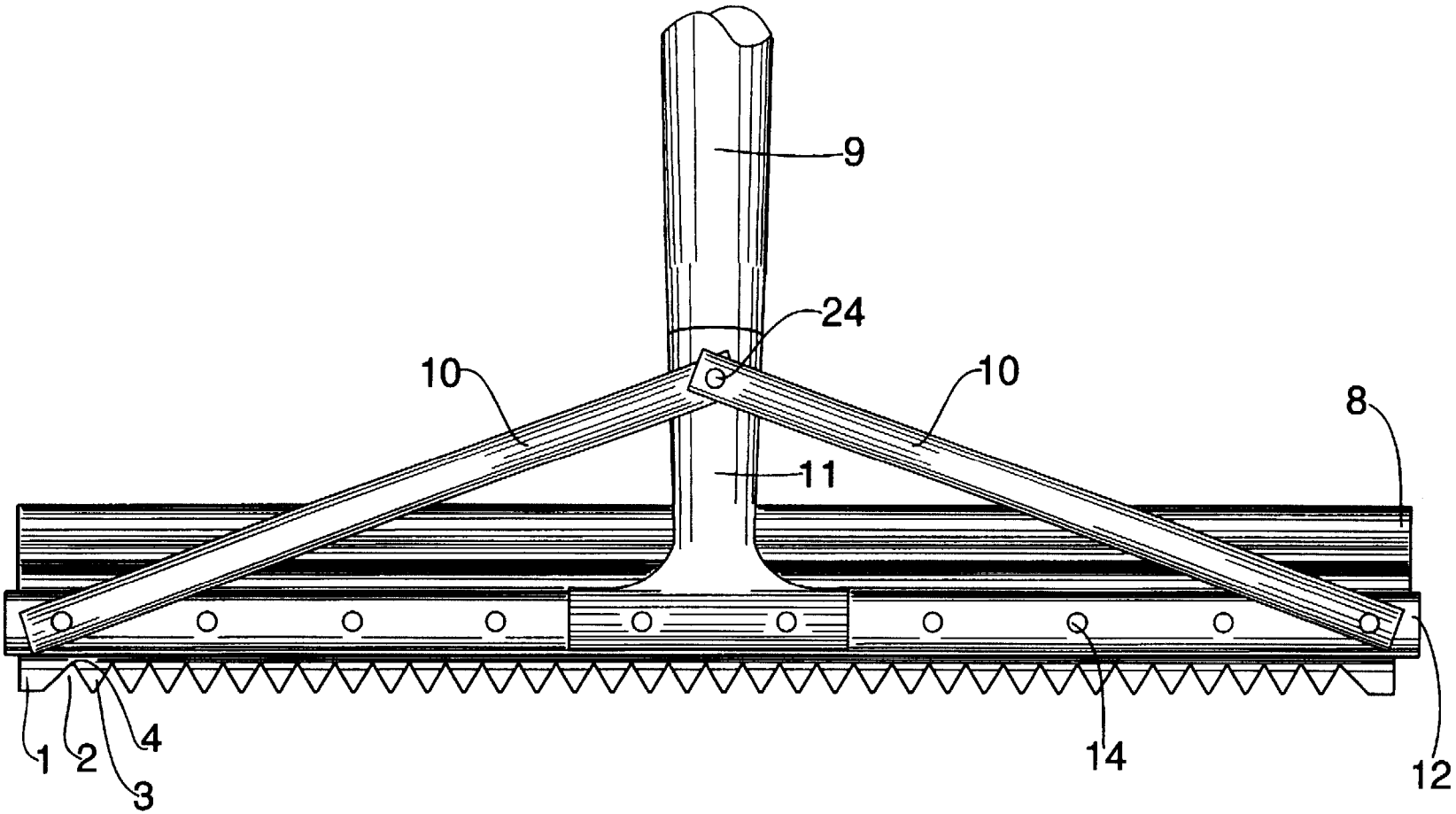
FIG. 3 is a rear elevation view of the spreader according to the present invention.

FIG. 3 is a rear elevation view of the spreader which illustrates more clearly how the handle 9 is attached by means of the bracket 11 and the braces 10. The braces 10 are attached to the back of the bracket 11 by a fastener 24. The braces 10 are also connected to the back of the L-bracket 12 by means of one of the nut 7 and bolt 6 combinations discussed previously. The bracket 11 is attached to the L-bracket 12 by two more nuts and bolts.

Figure 4:
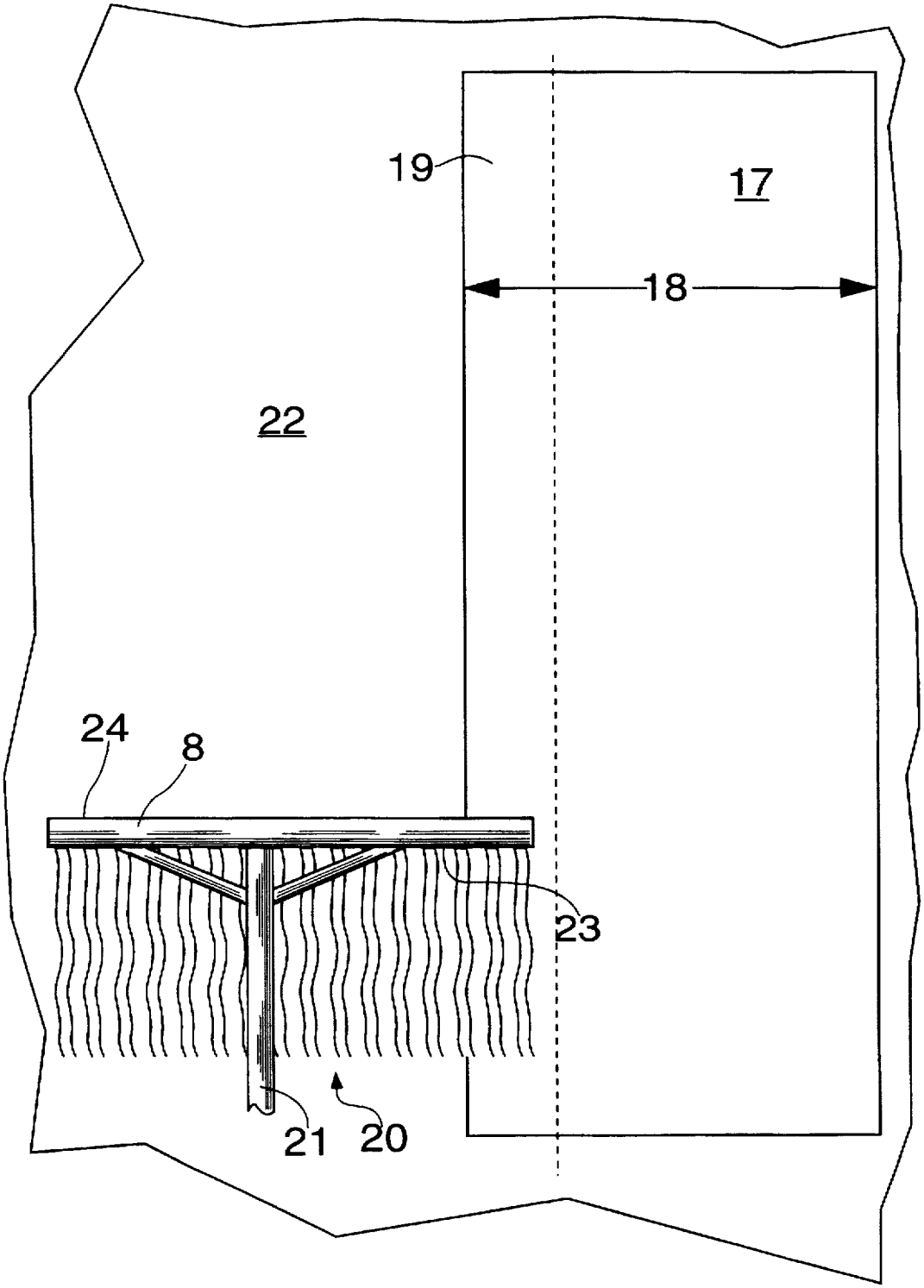
FIG. 4 is an elevation view of a roofer using the spreader to spread a desired thickness of coating over a predetermined width.

FIG. 4 illustrates the typical use of the inventive spreader. The first sheet of paper 17 has been previously laid on the roof. The paper 17 has a width 18, equal to the width of the blade of the inventive spreader. The paper 17 also has a built in overlap 19 of, as discussed previously, 4" or 17". The spreader 21 is positioned to spread a coat of cold-coat tar 20 over a length of roof surface 22, equal in width to the width of the next layer of paper (not shown) including the built in overlap 19. As the roofer pushes the tar 20 with the spreader 21 a number of ribbons of tar will be meted out by the serrations of the blade of the spreader. Because the blade covers exactly the width of the surface to be covered and the hood 8 prevents overflow, the roofer can typically cover the desired length and width of the roof surface in one pass.

Once the roofer has spread the desired coating of cold-coat tar 20, the roofer can then "walk out" the sheet of roofing paper, making sure to cover the built-in overlap 19 of the previous sheet of paper.

In a more preferred method, the roofer angles the spreader 21 such that the leading edge of the spreader 24 precedes the trailing edge of the spreader 23 by a small amount. By this method the roofer leaves a bead of tar on the previously laid sheet of paper. As discussed earlier, this bead is used to seal off the very edge of the subsequently laid sheet of roofing paper, thus preventing water from entering between the two sheets of paper.

I claim:

1. A spreader for spreading cold-coat roofing tar into generally uniform, substantially parallel adjacent ribbons over a section of a roof in a forward motion comprising;

an elongated, stiff blade having a bottom edge having a plurality of evenly spaced serrations throughout, said blade having front and back sides, a support bar attached to said front side of said blade, a hood attached to said back side of said blade and having a portion curving above and in front of said blade, an elongated blade bracket having two ends, said blade bracket being L-shaped in transverse cross section and overlying and attached to said hood such that said hood is sandwiched between the blade bracket and the back side of said blade, at least two braces attached to said blade bracket, a handle bracket overlying and attached to said blade bracket and to each of the braces, and a handle attached to said handle bracket.

2. A spreader of claim 1 wherein the blade is attached to the support bar, hood and blade bracket by a plurality of nut and bolt fasteners, spaced linearly and evenly, through the blade, support bar, hood and blade bracket.

3. A spreader of claim 2 wherein the braces are attached to the ends of the blade bracket by at least two of the nut and bolt fasteners attaching the blade, support bar, hood and blade bracket assembly.

4. A spreader of claim 2 wherein the handle bracket is attached to said blade bracket by at least two of the nut and bolt fasteners attaching the blade, support bar, hood and blade bracket.

5. A spreader of claim 1 wherein the handle bracket is attached to the braces by a fastener.

6. A spreader of claim 1 wherein the handle bracket is attached to the bracket by a fastener.

7. A spreader of claim 1 wherein the blade is about 36 in. long.

8. A spreader of claim 1 wherein the evenly spaced serrations are about one inch apart.

9. A spreader for spreading cold-coat roofing tar into a plurality of generally uniform, substantially parallel ribbons over a section of a roof in a generally forward motion, the spreader comprising:

(a) a hooded blade assembly, including:

(a.1) an elongated, stiff blade having a serrated bottom edge with a plurality of serrations evenly spaced therealong, said blade having forward and rearward sides;

(a.2) an elongated forward blade-clamping member positioned forward of the forward side of the blade and extending along a lengthwise direction of the blade with the serrated bottom edge of the blade projecting below a lower edge of said blade-clamping member;

(a.3) an elongated rearward blade-clamping member positioned rearward of the rearward side of the blade and extending along the lengthwise direction of the blade with the serrated bottom edge of the blade projecting below a lower edge of said blade-clamping member;

(a.4) clamping means for urging the forward and rearward clamping members together to clamp the serrated blade between the clamping members; and (a.5) an elongated hood attached to at least one of said clamping members, the hood having a curved portion curving above and forward of the blade;

(b) a handle bracket attached to the hooded blade assembly at a position on a rearward side of the assembly approximately centrally of the rearward side in a lateral dimension and a vertical dimension;

(c) at least two handle braces, each handle brace being attached at one end to the handle bracket and at an opposing end to the rearward side of the hooded blade assembly approximately centrally of the rearward side in a vertical dimension and spaced apart laterally from the handle bracket; and (d) a handle attached to the handle bracket.

10. The spreader according to claim 9 in which the hooded blade assembly further includes a tar run-off tube mounted on a forward side of the assembly below the curved portion of the hood at a lateral side of the assembly, the run-off tube being shaped and oriented so that in use the tube can form a bead of tar along one edge of the plurality of ribbons of cold-coat tar spread by the spreader.

11. The spreader according to claim 9 in which the hood has a lower portion clamped between the forward and rearward clamping members to attach the hood to the hooded blade assembly.

12. The spreader according to the claim 11 in which the lower portion of the hood is clamped between the rearward side of the blade and a forward side of the rearward clamping member.

13. The spreader according to claim 12 in which the clamping means for urging the forward and rearward clamping members together comprises a plurality of nut and bolt fasteners spaced at intervals laterally along the hooded blade assembly and passing through the rearward clamping member, the lower portion of the hood, the blade, and the forward clamping member.

14. The spreader according to claim 12 in which the rearward clamping member is L-shaped in traverse cross section.

15. The spreader according to claim 9 in which the blade is composed of a hardrubber material.

16. The spreader according to claim 9 in which the blade is about 36 inches long.

17. The spreader according to claim 9 in which the serrations are spaced about one inch apart.

* * * * *